United States Patent [19]

Tontarelli

[11] 4,305,515

[45] Dec. 15, 1981

[54] AUTOMATICALLY SEALING BOTTLE STOPPER

[76] Inventor: Sergio Tontarelli, Via Mordini Circiaco 37, Castelfidardo (AN), Italy

[21] Appl. No.: 111,648

[22] Filed: Jan. 14, 1980

[51] Int. Cl.[3] ..... B65D 41/16

[52] U.S. Cl. ..... 215/244; 222/517

[58] Field of Search ..... 215/235, 244, 245; 222/469, 517, 556

[56] References Cited

U.S. PATENT DOCUMENTS

| | | | |
|---|---|---|---|
| 2,312,380 | 3/1943 | Bernhardt | 222/517 |
| 2,573,378 | 10/1951 | Zurlinden | 215/235 |
| 3,028,034 | 4/1962 | Freiman | 215/235 |

FOREIGN PATENT DOCUMENTS

| | | | |
|---|---|---|---|
| 20195 | 10/1916 | France | 215/235 |
| 640567 | 3/1962 | Italy | 222/517 |
| 91158 | 12/1937 | Sweden | 215/244 |
| 972739 | 10/1964 | United Kingdom | 215/235 |

*Primary Examiner*—Donald F. Norton

*Attorney, Agent, or Firm*—Blair, Brown & Kreten

[57] ABSTRACT

Disclosed herein is a bottle stopper for automatically sealing the pouring spout of a bottle which in a preferred form includes a liquid within the bottle that is carbonated. The stopper is suitably formed of a single piece of material including a capsule which overlies the bottle neck and its associated toroidal lip of the bottle, a lever operatively connected to the capsule by means of a resilient tongue, in which the lever is biased to normally provide a stopper connected at a terminal extremity of the lever into sealing engagement with the top portion of the capsule.

5 Claims, 2 Drawing Figures

AUTOMATICALLY SEALING BOTTLE STOPPER

BACKGROUND, SUMMARY AND OBJECTS OF THE INVENTION

A primary object of this invention is to provide an automatic closing device for bottles of mineral water to be fitted on to the bottle after the original metal crown cap with which it was sold has been removed.

At present various tops and caps for temporarily closing a bottle whilst the drink is being consumed are available.

For instance, small flexible plastic caps can be found which are simply pushed externally over the mouth of the bottle. These caps are attached by a strip to a ring which is slipped over the neck of the bottle.

Other types made of metal or china with rubber seals are held in place by clips or levers which fit round the neck of the bottle.

This invention has for its object to provide a new and alternative type of closing device to those already in use. It is, however, characterized by an automatic closing action and therefore does not require any special means of application nor any effort on the part of the user.

BRIEF DESCRIPTION OF THE DRAWING FIGURES

For the sake of clearness the accompanying drawings should be continually referred to. They are, however, only indicative and not restrictive in that FIG. 1 is a perspective view of said closing device and FIG. 2 a cross-section.

DESCRIPTION OF THE PREFERRED EMBODIMENT

Figure 2:
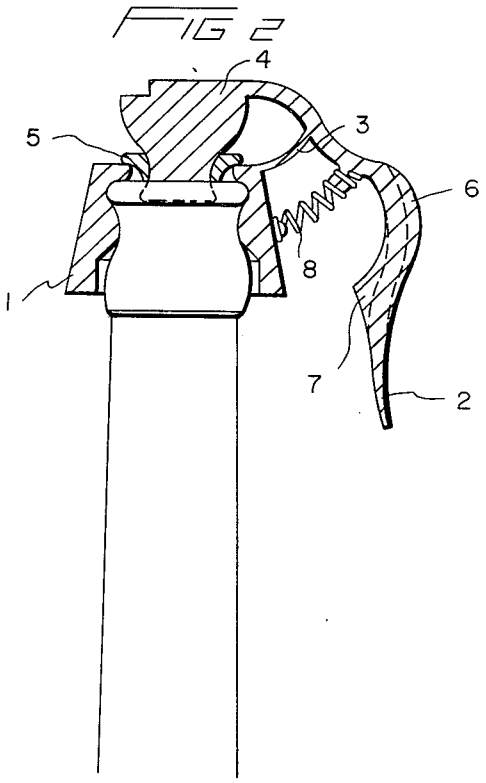
Figure 1:
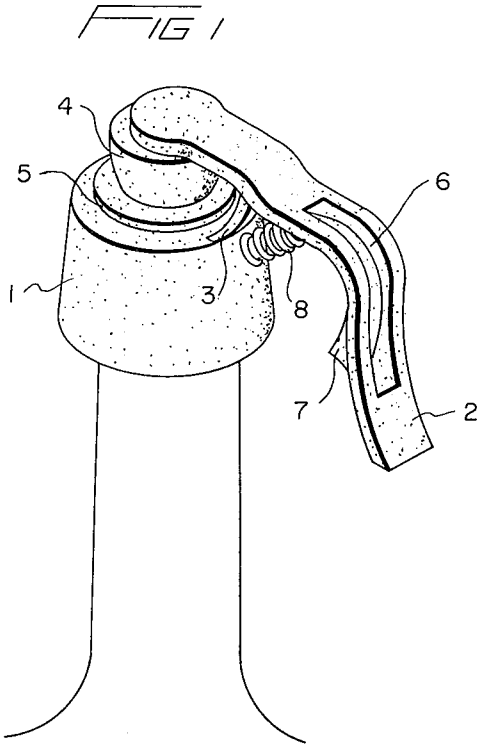

As illustrated in the attached drawings the closing device which is made entirely of plastic consists of a capsule (1), externally of a truncated-cone shape which is tapered towards the top, whilst internally there is a circular ridge about midway up followed by an annular groove into which the toroidal lip found at the mouth of the bottles of mineral water, or other drinks, fits under slight pressure.

A curved and suitably shaped lever (2) is hinged by a tongue (3) made of the same plastic material as is the whole device, to the upper edge of the aforesaid capsule (1).

This lever (2) ends above the capsule in a stopper (4) fitted with a rubber ring (5) which hermetically seals the top opening of the capsule (1).

Moreover, said lever (2) which also acts as the handgrip, is reinforced by both an outer rib (6) and an inner one (7) which, when the lever is rotated to a maximum stops against the capsule (1).

To ensure that the stopper (4) fits tightly and securely in the opening on the capsule a compressed spring (8) has been inserted between the outside wall of the capsule (1) and the inside wall of the lever-handgrip.

It can be thus clearly seen that this invention provides both a functional and original closing device for bottles.

In addition, by gripping the neck of the bottle while pouring, the lever (2) can also be controlled in that said lever being hinged to the tongue (3) removes the stopper (4) from the opening; the stopper then remains in an open position the whole time the bottle is being used.

Once the drink has been served the bottle can be left to stand and the stopper (4) biased by the spring (8) will automatically return and close it.

The invention has been described and illustrated in its preferred form, but its shape and external profile may, of course, be modified to meet other requirements.

What I claim is:

1. A closing device for sealing liquids in a bottle comprising, in combination;

a capsule having an inner contour adapted to tightly engage the toroidal lip on the mouth of a bottle, a tongue hinged to an outer portion of said capsule formed integrally and of the same material as said capsule, a lever formed integrally to an extremity of said tongue remote from said capsule and of the same material on said capsule, said lever having an extremity above said capsule formed as a stopper, and a second extremity serving as a handgrip whereby when said handgrip is pressed towards an outer contour of said capsule, said stopper is removed from said capsule, biasing means fixedly interposed between said capsule and said lever on a side of said tongue opposite said stopper whereby releasing said handgrip inserts said stopper into said capsule, and sealing means on a surface of said stopper which extends into said capsule for sealing contents within the bottle.

2. The device of claim 1 wherein said capsule is formed from plastic and is formed externally as a truncated cone.

3. The device of claim 2 wherein said capsule is internally provided with a circular ridge substantially medially disposed which is adapted to fit over the bottle's toroidal lip when said capsule is forced thereover.

4. The device of claim 3 wherein said biasing means comprise a spring.

5. The device of claim 4 wherein said sealing means comprises a rubber ring fitted over said stopper, and wherein said lever is reinforced by inner and outer ribs integrally formed and made from plastic, said inner rib serving as an abutment against said capsule when said stopper is removed.

* * * * *